US010315069B1

(12) United States Patent
Maresh et al.

(10) Patent No.: US 10,315,069 B1
(45) **Date of Patent: *Jun. 11, 2019**

(54) EXERCISE MACHINE

(71) Applicants: Joseph D Maresh, West Linn, OR (US); Kenneth W Stearns, Houston, TX (US)

(72) Inventors: Joseph D Maresh, West Linn, OR (US); Kenneth W Stearns, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/615,825

(22) Filed: Jun. 6, 2017

Related U.S. Application Data

(60) Provisional application No. 62/392,617, filed on Jun. 6, 2016.

(51) Int. Cl.

| | |
|---|---|
| ***A63B 21/00*** | (2006.01) |
| ***A63B 23/04*** | (2006.01) |
| ***A63B 21/22*** | (2006.01) |
| ***A63B 23/035*** | (2006.01) |

(52) U.S. Cl.
CPC ..... *A63B 23/0405* (2013.01); *A63B 21/154* (2013.01); *A63B 21/225* (2013.01); *A63B 21/4034* (2015.10); *A63B 21/4035* (2015.10); *A63B 21/4047* (2015.10); *A63B 21/4049* (2015.10); *A63B 23/03575* (2013.01); *A63B 23/0476* (2013.01)

(58) Field of Classification Search
None
See application file for complete search history.

(56) References Cited

U.S. PATENT DOCUMENTS

| | | | | |
|---|---|---|---|---|
| 8,147,384 | B2 * | 4/2012 | Stearns | A63B 22/001 482/52 |
| 8,272,995 | B2 * | 9/2012 | Stearns | A63B 22/001 482/52 |
| 8,852,059 | B1 * | 10/2014 | Stearns | A63B 22/001 482/52 |
| 2002/0155926 | A1 * | 10/2002 | Lat | A63B 21/015 482/52 |
| 2003/0216222 | A1 * | 11/2003 | Kuo | A63B 22/0056 482/52 |
| 2005/0272562 | A1 * | 12/2005 | Alessandri | A63B 21/154 482/52 |
| 2006/0046902 | A1 * | 3/2006 | Chang | A63B 22/0664 482/52 |
| 2007/0298935 | A1 * | 12/2007 | Badarneh | A63B 22/001 482/52 |
| 2008/0146417 | A1 * | 6/2008 | Chang | A63B 22/0064 482/70 |
| 2009/0209395 | A1 * | 8/2009 | Maresh | A63B 21/0051 482/52 |

(Continued)

*Primary Examiner* — Stephen R Crow
(74) *Attorney, Agent, or Firm* — Nick A Nichols, Jr.

(57) ABSTRACT

In an exercise machine, foot platforms may travel in inclined circular paths to establish three dimensional operational characteristics. Platform support members may be rotationally synchronized by connected mechanical components such that they are maintained out of phase with each other by one half of a cycle or 180 degrees in counter rotational directions. Crank synchronization in an inclined plane during operation of the exercise machine may provide three-dimensional foot travel in vertical, lateral and longitudinal directions.

10 Claims, 4 Drawing Sheets

(56) References Cited

U.S. PATENT DOCUMENTS

| | | | | |
|---|---|---|---|---|
| 2012/0004077 | A1* | 1/2012 | Chu | A63B 21/225<br>482/52 |
| 2016/0089562 | A1* | 3/2016 | Grossmann | A63B 21/4047<br>482/52 |

* cited by examiner

EXERCISE MACHINE

CROSS-REFERENCE TO RELATED APPLICATION

This application claims the benefit of U.S. Provisional Application Ser. No. 62/392,617, filed Jun. 6, 2016, which application is incorporated herein by reference in its entirety.

BACKGROUND

The present invention relates to an exercise machine, more particularly, a stationary exercise machine which provides vertical, lateral and longitudinal foot path motion to exercise lower body muscles.

Three popular categories of exercise machines known to exercise various muscle groups in the human body include bicycle machines, stair steppers, and skiing machines. These machines have been successful because they offer an effective form of an aerobic, low impact exercise.

Bicycle machines provide resistance to leg motion by causing two foot petals to resistively travel along a circular path, mutually in the same direction, about a coaxial, horizontal axis of rotation, while maintaining the pedals diametrically opposite and with constant lateral distance between them.

Stair steppers provide resistance to leg motion such that work is performed during the unbending (or straightening) of each leg as two pedals or foot platforms are continuously and alternatively stepped upon and released.

Skiing machines offer resistance to leg motion by allowing two foot platforms to alternately travel rearward with resistance and forward with minimal resistance in a linear side by side manner. During use, dependent upon the specific machine design, the two foot platforms may have to be continuously coordinated and synchronized by the user to be out of phase with each other by half of a cycle.

SUMMARY

In an exercise machine, foot platform support members, each with their own distinct axis of rotation, may include a foot platform rotatably installed at an outer end. The foot platforms may travel in inclined circular paths to establish the three dimensional operational characteristics. The platform support members may be rotationally synchronized by connected mechanical components such that they are maintained out of phase with each other by one half of a cycle or 180 degrees in counter rotational directions. Inertial characteristics during operation, may be provided by a mechanical flywheel, with its respective driven pulley, installed remote from the platform support members, and belt or chain driven by a drive pulley secured at an inner end to one of the rotatable platform support members. Crank synchronization in an inclined plane at angle β during operation of the exercise machine may provide three-dimensional foot travel in vertical, lateral and longitudinal directions.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
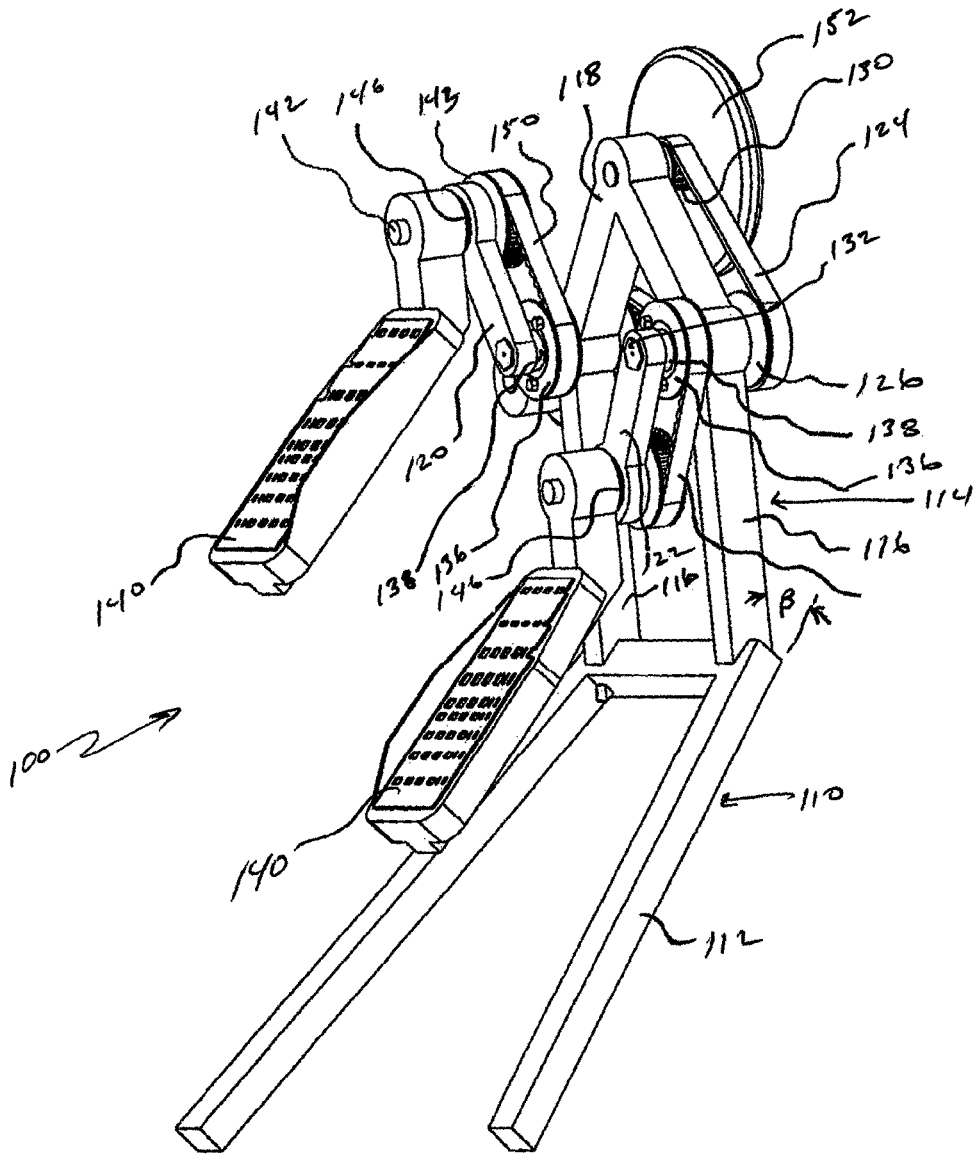
FIG. 1 is a perspective view of an exercise machine.
Figure 2:
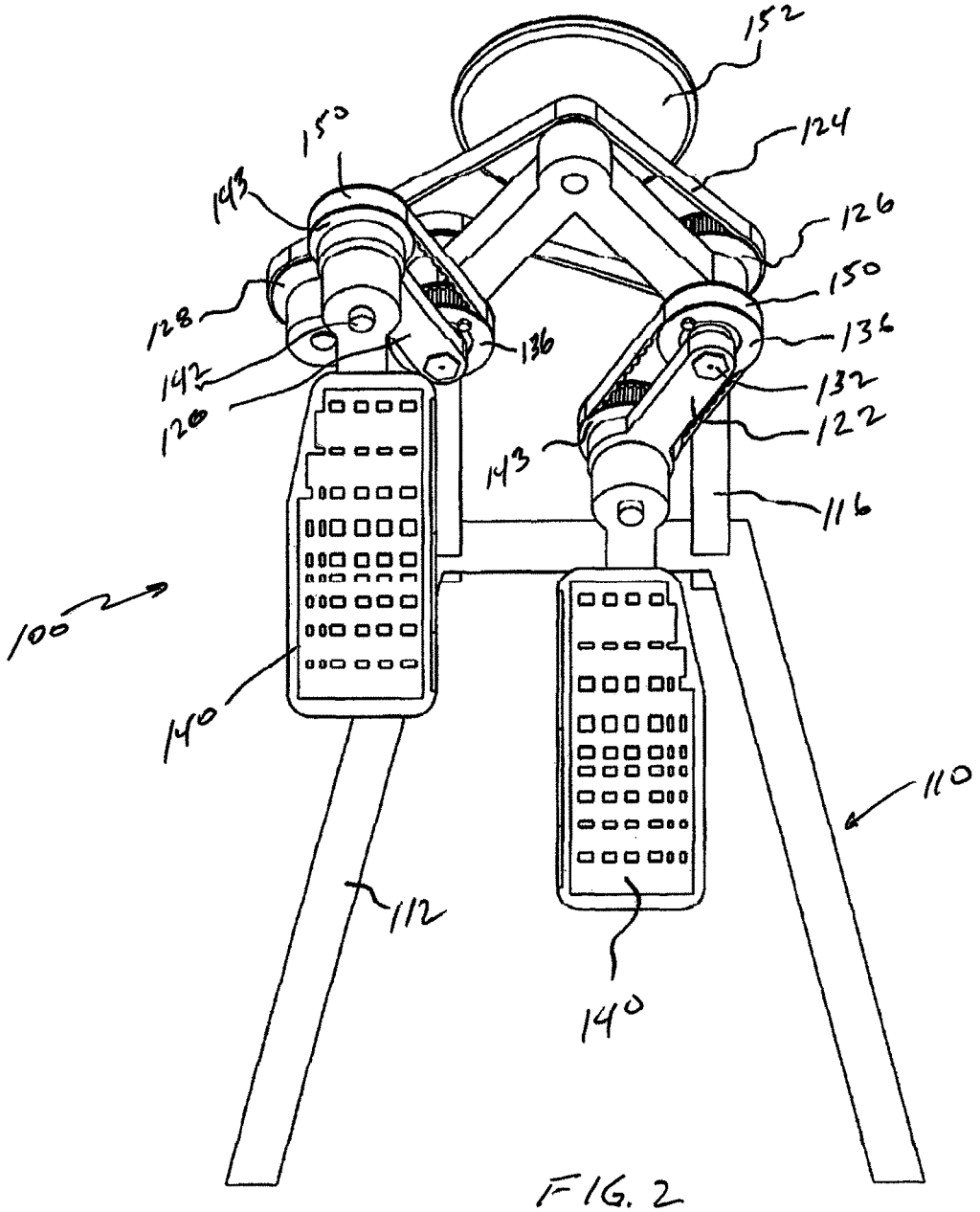
FIG. 2 is a rear partial perspective view of the exercise machine shown in FIG. 1.
Figure 4:
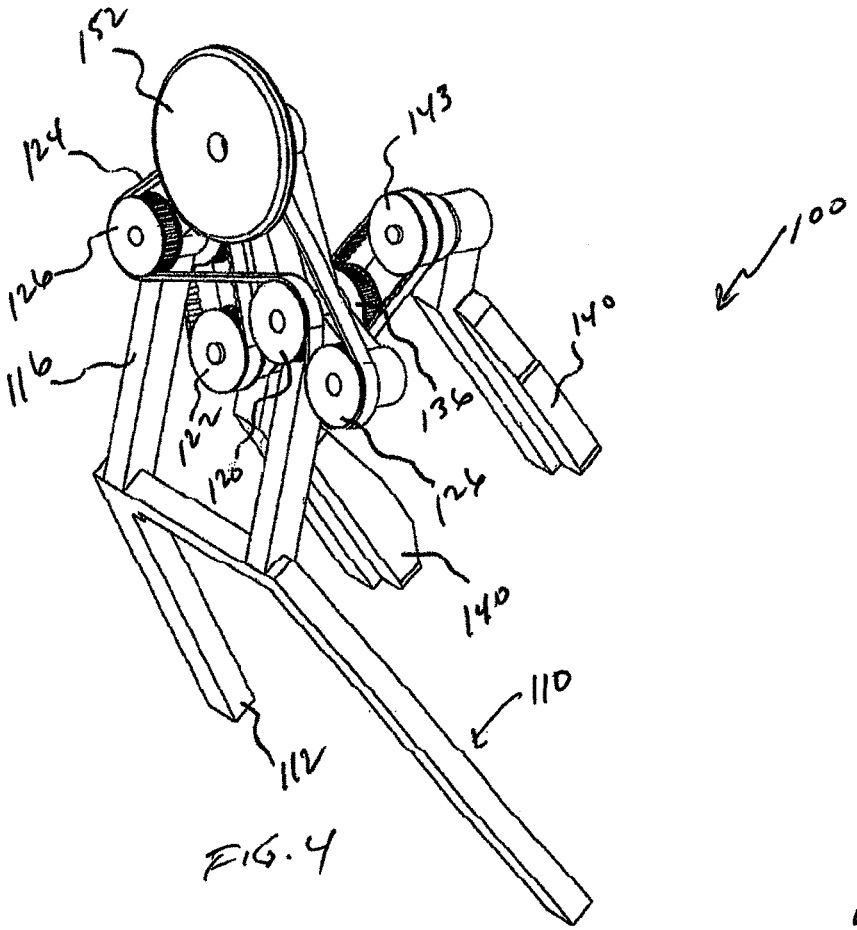
FIG. 4 is a front perspective view of the exercise machine shown in FIG. 1.
Figure 3:
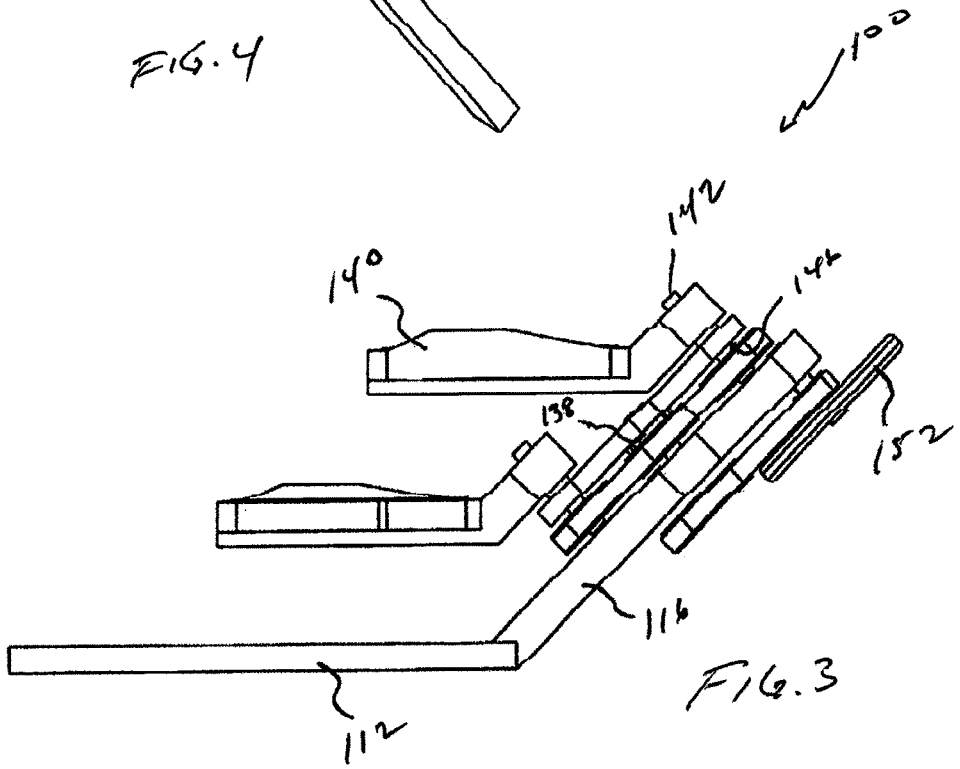
FIG. 3 is a side view of the exercise machine shown in FIG. 1.

Referring first to FIG. 1, an exercise machine in generally identified by the reference numeral 100. The exercise machine 100 may include a frame 110 configured to rest on a substantially flat surface, such as but without limitation, a floor surface. The frame 110 may include a base 112 and a stanchion 114 extending angularly upward and forward from proximate a forward end of the base 112. The stanchion 114 may be inclined in a forward direction at an angle β relative to a horizontal plane defined by the base 112. The angle β may, for example but without limitation, may be about sixty(60°) degrees.

The stanchion 114 may include a pair of stanchion leg members 116 spaced apart from one another. A frame bridge member 118 may extend across the space separating the stanchion leg members 116. Opposite distal ends of the stanchion bridge member 118 may be fixedly secured to the upper distal ends of the stanchion leg members 116. Alternatively, the stanchion 114 may be fabricated as a single unitary frame member fixedly secured proximate the forward end of the base 112.

The exercise machine 100 may include a stationary handle bar (not shown in the drawings) for grasping by an operator while exercising. It may be noted that a stationary handle bar may be replaced with handles which move under resistance, if an upper body workout is also desired. Such handles may for example pivot about an axis perpendicular to the side of the exercise machine 100, and be bent such that the hand grips are located at a comfortable position to operate. Because various designs of upper body workout handles, poles, or cranks or levers are incorporated upon many different categories of exercise machines, the potential for including any one of them upon the exercise machine 100 is considered obvious.

Left and right cranks 120, 122 may be rotatably secured to the stanchion 114. A flywheel timing belt 124 may engage a series of timing pulleys 126, 128 and 130 in a circuitous manner so that counter rotation of the cranks 120, 122 may be established in a manner known in the art.

Left and right cranks 120, 122 may be rotatably mounted at proximate the upper distal ends of respective stanchion leg members 116 and rigidly secured to respective crank shafts 132. The crank shafts 132 may extend through respective boreholes 133 in the stanchion leg members 116. The crank shafts 132 may be keyed to respective timing pulleys 126 by a key and slot 134 connection so that the cranks shafts 120, 122 and respective timing pulleys 126 rotate together.

The crank shafts 132 may extend through respective fixed timing pulleys 136 disposed between the cranks 120, 122 and stanchion leg members 116. The crank shafts 132 may be rotatably secured to respective fixed timing pulleys 136 by radial and thrust bearings 138. The fixed timing pulleys 136, radial and thrust bearings 138 and boreholes 133 may be concentric to one another.

Figure 5:
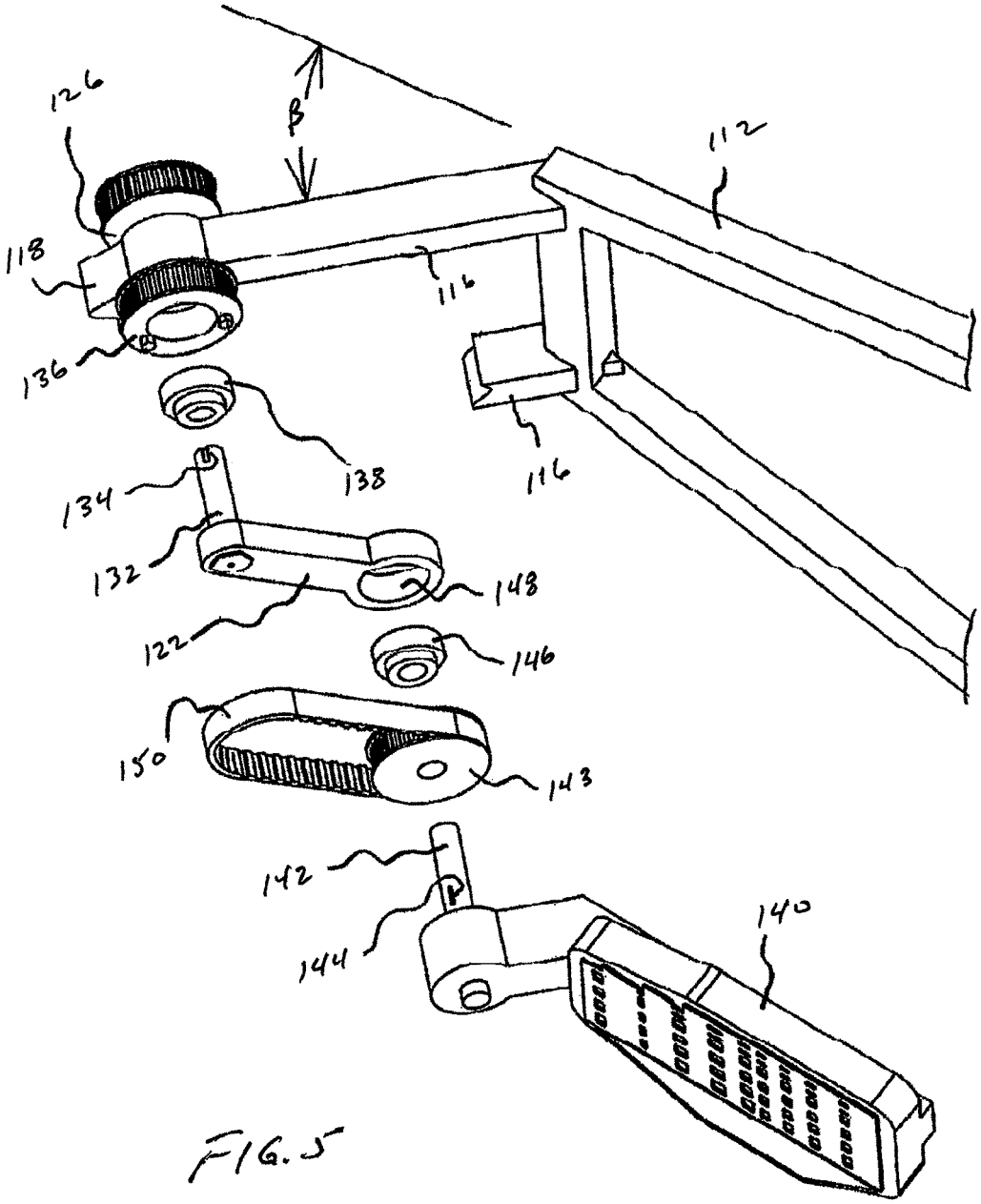
FIG. 5 is an exploded partial perspective view of the exercise machine shown in FIG. 1.

The exercise machine 100 may include foot platforms 140 supported by respective cranks 120, 122. Foot platform shafts 142 may rigidly secure the foot platforms 140 to respective timing pulleys 143 by a key and slot 144 connection. The foot platform shafts 142 may be rotatably secured to respective cranks 120, 122 by radial and thrust bearings 146 concentrically received in a bore 148 of respective cranks 120, 122, best shown in Fig. 5.

Referring again to FIG. 1, synchronization timing belts 150 may engage respective timing pulleys 143 and fixed timing pulleys 136. As timing pulleys 143 orbit fixed timing pulleys 136 in an inclined plane while engaging orbital synchronization timing belts 150 the orientation of the foot platforms 140 remains constant while the foot platforms 140 move in three dimensions. Timing belts 124, 150 and timing pulleys 126, 130, 136, 143 may cooperatively interconnect to define a synchronization linkage interconnecting the left and right cranks 120, 122 for moving the left and right foot platforms 140 in inclined paths defining three-dimensional foot travel. Inertia of the exercise machine 100 due to rotation of the flywheel 152 may be provided while left and right timing pulleys 126 drive timing belt 124, thereby causing rotation of idler pulley 128 and flywheel pinion pulley 130. It may be observed that crank synchronization lies in an inclined plane at angle β during operation of the exercise machine 100 while providing three-dimensional foot travel in vertical, lateral and longitudinal directions, more fully described in U.S. Pat. No. 5,595,554 which is incorporated herein by reference in its entirety.

Generally, the three spatial dimensions that an operator may experience include, a first spatial dimension corresponding to the forward and back (longitudinal) motion of the foot pedals traveling along their inclined circular paths. The magnitude of the first dimension is inversely proportional to the angle β to which the plane defining the circular path of the foot pedals has been inclined from horizontal. The second spatial dimension corresponds to the up and down (vertical) motion of the foot platforms traveling along their inclined circular paths. The magnitude of the second dimension is directly proportional to the inclination angle β of the circular path plane, and as follows, would be zero if the path is level. The third spatial dimension corresponds to the side to side (transverse) motion of the foot platforms traveling along their circular path, and, because the path plane has not been inclined transversely, the magnitude of this third dimension is not a function of the degree to which the inclined path of the foot pedals traveling along their circular paths has been inclined.

While a preferred embodiment of the invention has been shown and described, other and further embodiments of the invention may be devised without departing from the basic scope thereof, and the scope thereof is determined by the claims which follow.

The invention claimed is:

1. An exercise apparatus, comprising:

a) a frame configured to rest on a flat surface;

b) a left crank rotatably mounted on the frame for rotation about a left crank axis;

c) a right crank rotatably mounted on the frame for rotation about a right crank axis, wherein said left crank axis and said right crank axis are spaced apart from one another;

d) a left foot support platform rotatably connected to said left crank, and a right foot support platform rotatably connected to said right crank; and e) synchronization linkage movably interconnecting said left crank and said right crank in a manner to move said left foot platform and said right foot platform in respective inclined circular paths defining three-dimensional foot travel.

2. The apparatus of claim 1 wherein three-dimensional foot travel includes a vertical dimension, a lateral dimension and a longitudinal dimension.

3. The apparatus of claim 1 including first radial thrust bearings connecting said left foot support platform and said right foot platform to respective said left crank and said right crank.

4. The apparatus of claim 3 including second radial thrust bearings connecting respective said left crank and said right crank to said frame.

5. The apparatus of claim 1 wherein said frame includes a substantially horizontal base and a stanchion extending upward from proximate a forward end of said base at an angle of about 60 degrees from a horizontal plane defined by said base of said frame.

6. The apparatus of claim 1 wherein said frame includes a substantially horizontal base and a stanchion extending angularly upward from proximate a forward end of said base, and wherein said respective circular paths lie in an inclined plane defined by an angular orientation of said stanchion relative to said base of said frame.

7. The apparatus of claim 1 wherein said synchronization linkage includes a timing belt interconnecting said left crank and a respective said left foot support platform and said right crank and a respective said right foot support platform.

8. The apparatus of claim 1 wherein said synchronization linkage maintains said left foot support member and said right foot support member out of phase with each other by one half of a cycle or 180 degrees in counter rotational directions.

9. The apparatus of claim 1 wherein said synchronization linkage includes a flywheel timing belt in circuitous engagement with a plurality of timing pulleys for counter rotating said left crank and said right crank.

10. The apparatus of claim 7 wherein said synchronization linkage maintains said left foot support platform and said right foot support platform at a constant orientation while traveling in three dimensions.

* * * * *